US012690608B2

(12) United States Patent
Lu et al.

(10) Patent No.: US 12,690,608 B2
(45) **Date of Patent: *Jul. 28, 2026**

(54) ARECOLINE SALT AND PREPARATION METHOD AND PRODUCT THEREOF

(71) Applicants: SHENZHEN FIRST UNION TECHNOLOGY CO., LTD., Shenzhen City (CN); SHENZHEN HERUI BIOTECHNOLOGY CO., LTD., Shenzhen City (CN)

(72) Inventors: Jin Lu, Shenzhen (CN); Guofeng Fu, Shenzhen (CN); Ming Chu, Shenzhen (CN); Xing Zhou, Shenzhen (CN); Wenwen Huang, Shenzhen (CN); Zhongli Xu, Shenzhen (CN); Yonghai Li, Shenzhen (CN)

(73) Assignees: SHENZHEN FIRST UNION TECHNOLOGY CO., LTD., Shenzhen City (CN); SHENZHEN HERUI BIOTECHNOLOGY CO., LTD., Shenzhen City (CN)

( * ) Notice: Subject to any disclaimer, the term of this patent is extended or adjusted under 35 U.S.C. 154(b) by 526 days.

This patent is subject to a terminal disclaimer.

(21) Appl. No.: 17/914,842

(22) PCT Filed: Mar. 26, 2021

(86) PCT No.: PCT/CN2021/083407
§ 371 (c)(1),
(2) Date: Sep. 27, 2022

(87) PCT Pub. No.: WO2021/190645
PCT Pub. Date: Sep. 30, 2021

(65) Prior Publication Data

US 2023/0148653 A1 May 18, 2023

(30) Foreign Application Priority Data

Mar. 27, 2020 (CN) ..... 202010227895.8
Jun. 24, 2020 (CN) ..... 202010588490.7

(51) Int. Cl.
*A24B 15/167* (2020.01)

(52) U.S. Cl.
CPC ..... *A24B 15/167* (2016.11)

(58) Field of Classification Search
None
See application file for complete search history.

(56) References Cited

U.S. PATENT DOCUMENTS

| | | | |
|---|---|---|---|
| 2,557,353 A | | 6/1951 | Kartsonis et al. |
| 2011/0139166 A1 | | 6/2011 | Luzenberg, Jr. |

FOREIGN PATENT DOCUMENTS

| | | | | |
|---|---|---|---|---|
| CN | 1186614 | A | | 7/1998 |
| CN | 1651432 | | * | 8/2005 |
| CN | 1651432 | A | * | 8/2005 |
| CN | 101624368 | | * | 1/2010 |
| CN | 101624368 | A | * | 1/2010 |
| CN | 101912496 | A | | 12/2010 |
| CN | 103461641 | A | | 12/2013 |
| CN | 103504431 | A | | 1/2014 |
| CN | 105263345 | A | | 1/2016 |
| CN | 109288115 | A | | 2/2019 |
| CN | 110771946 | A | | 2/2020 |
| JP | S50-94132 | | | 7/1975 |
| JP | H11-192069 | A | | 7/1999 |
| WO | 2018/207888 | A1 | | 11/2018 |

OTHER PUBLICATIONS

Johnson et al (International Journal of Toxicology, 2017, vol. 36 (Supplement 3) 5S-30S). (Year: 2017).*
Japanese Notice of Reasons for Refusal dated Dec. 25, 2025 received in Japanese Patent Application No. 2024-174421.
Notification of Examination Opinion dated Nov. 28, 2025 received in Taiwanese Patent Application No. 110123206.

* cited by examiner

*Primary Examiner* — Celeste A Roney
(74) *Attorney, Agent, or Firm* — Scully, Scott, Murphy & Presser, P.C.

(57) ABSTRACT

This application provides an arecoline salt and a preparation method and a product thereof. The arecoline salt is a benzoate of arecoline, with a structural formula shown as follows:

where X is a molar ratio of arecoline to benzoic acid. The arecoline salt, with good physicochemical stability, is convenient to use and widely used.

20 Claims, 6 Drawing Sheets

ARECOLINE SALT AND PREPARATION METHOD AND PRODUCT THEREOF

CROSS-REFERENCE TO RELATED APPLICATIONS

This application is a 35 U.S.C. § 371 National Phase conversion of International (PCT) Patent Application No. PCT/CN2021/083407, filed on Mar. 26, 2021, which claims the priority to Chinese Patent Application No. 202010227895.8 filed with China National Intellectual Property Administration on Mar. 27, 2020 and entitled "AEROSOL GENERATION SUBSTRATE", and Chinese Patent Application No. 202010588490.7 filed with China National Intellectual Property Administration on Jun. 24, 2020 and entitled "ARECOLINE SALT AND PREPARATION METHOD AND PRODUCT THEREOF", the contents of which are incorporated herein by reference in their entireties. The PCT International Patent Application was filed and published in Chinese.

TECHNICAL FIELD

This application belongs to the field of chemical synthesis technologies, and relates to an arecoline salt and a preparation method and a product thereof.

BACKGROUND

Arecoline, with a chemical name of "1,2,5,6-tetrahydro-1-methyl-3-pyridinecarboxylic acid methyl ester", is an oily liquid with a cholinergic effect. Arecoline is a compound with great application value, and preparation methods and applications thereof have always attracted attention of people.

SUMMARY

According to a first aspect, this application provides an arecoline salt. The arecoline salt is a benzoate of arecoline, with a structural formula shown as follows:

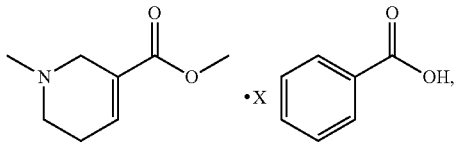

where X is a molar ratio of arecoline to benzoic acid.

In some embodiments, X has a value of $0<X\leq10$, preferably $0<X\leq8$, further preferably $0<X\leq6$, further preferably $0<X\leq5$, further preferably $0<X\leq3$, and further preferably $0<X\leq2$.

In some embodiments, the arecoline salt has a structural formula as follows:

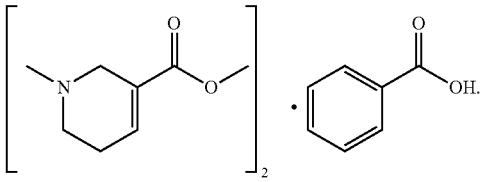

In some embodiments, the arecoline salt has a structural formula as follows:

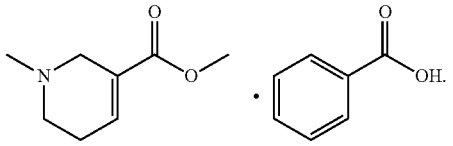

In some embodiments, the arecoline salt has a structural formula as follows:

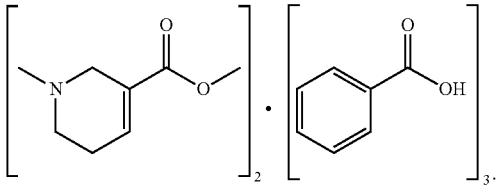

In some embodiments, the arecoline salt has a structural formula as follows:

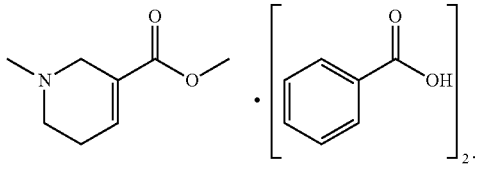

According to a second aspect, this application provides a preparation method for an arecoline salt, the method includes the following steps: placing arecoline in a reactor, adding benzoic acid under stirring and heating for dissolution to obtain the arecoline salt;

the prepared arecoline salt has a structural formula as follows:

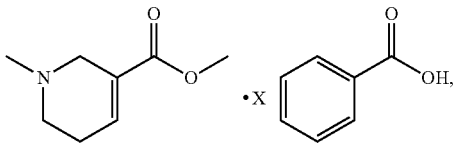

where X is a molar ratio of the arecoline to the benzoic acid.

In some embodiments, the heating is carried out at 20-100° C., preferably 20-80° C., further preferably 40-80° C., further preferably 50-80° C., and further preferably 50-70° C.

In some embodiments, X has a value of $0<X\leq10$, preferably $0<X\leq8$, further preferably $0<X\leq6$, further preferably $0<X\leq5$, further preferably $0<X\leq3$, and further preferably $0<X\leq2$.

In some embodiments, the prepared arecoline salt has a structural formula as follows:

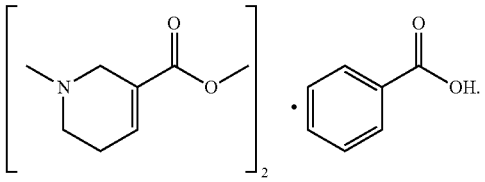

In some embodiments, the prepared arecoline salt has a structural formula as follows:

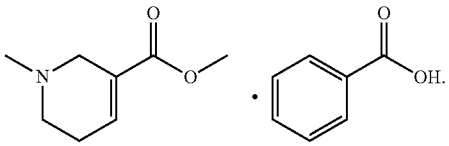

In some embodiments, the prepared arecoline salt has a structural formula as follows:

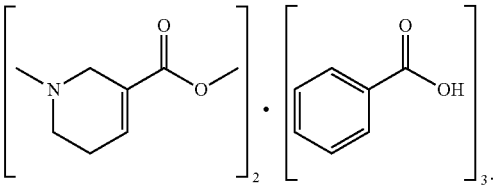

In some embodiments, the prepared arecoline salt has a structural formula as follows:

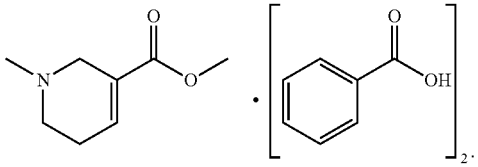

According to a third aspect, this application provides a preparation method for an arecoline salt, the method includes the following steps:

dissolving arecoline hydrobromide in water to obtain an aqueous arecoline hydrobromide solution;

adjusting the aqueous arecoline hydrobromide solution to an alkalinity, and extracting with an organic solvent to obtain an organic solvent layer and a water layer; and adding benzoic acid to the organic solvent layer for dissolution to obtain an arecoline salt;

the arecoline salt has a structural formula as follows:

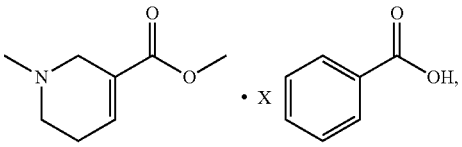

where X is a molar ratio of the arecoline to the benzoic acid.

In some embodiments, the preparation method further includes the following steps: adding water to the organic solvent layer for back extraction, and adjusting a water phase to an alkalinity to obtain a secondary organic solvent layer and a water layer; and adding benzoic acid to the secondary organic solvent layer for dissolution to obtain an arecoline salt.

In some embodiments, the alkalinity is that the adjusted water phase has a pH value of 7-10, preferably 7-9.5, further preferably 7-9, further preferably 7.5-9, and further preferably 8-9.

In some embodiments, after the secondary organic solvent layer is dried, benzoic acid is added for dissolution to obtain an arecoline salt.

In some embodiments, a desiccant is selected from the group consisting of at least one of phosphorus pentoxide, silica gel, caustic soda, lime, soda lime, anhydrous calcium chloride, anhydrous sodium sulfate and anhydrous magnesium sulfate; preferably anhydrous sodium sulfate.

In some embodiments, the obtained arecoline salt is concentrated and dried to improve purity of the arecoline salt.

In some embodiments, the adjusted aqueous arecoline hydrobromide solution has a pH value of 7-10, preferably 7-9.5, further preferably 7-9, further preferably 7.5-9, and further preferably 8-9.

In some embodiments, the organic solvent is selected from the group consisting of at least one of:

ethyl acetate, benzene, toluene, xylene, petroleum ether, methyl ether, ethyl ether, methyl tert-butyl ether, dichloromethane, trichloromethane, tetrahydrofuran and n-butyl alcohol; preferably ethyl acetate.

In some embodiments, X has a value of $0<X\leq10$, preferably $0<X\leq8$, further preferably $0<X\leq6$, further preferably $0<X\leq5$, further preferably $0<X\leq3$, and further preferably $0<X\leq2$.

In some embodiments, the prepared arecoline salt has a structural formula as follows:

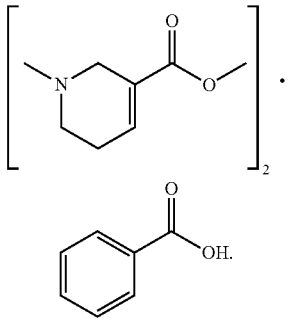

In some embodiments, the prepared arecoline salt has a structural formula as follows:

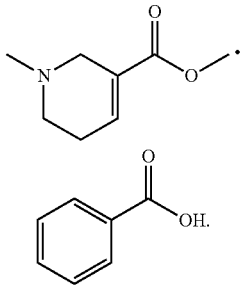

In some embodiments, the prepared arecoline salt has a structural formula as follows:

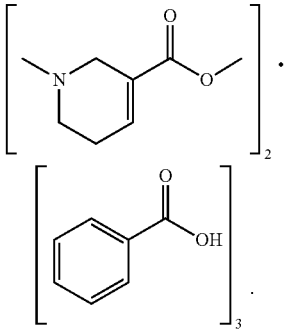

In some embodiments, the prepared arecoline salt has a structural formula as follows:

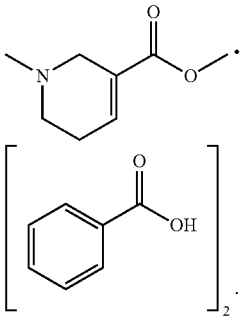

According to a fourth aspect, this application provides a product including the arecoline salt.

In some embodiments, the product is an aerosol generation substrate configured to be atomized to generate a smokable aerosol; or the product is a filter capsule, a chewing gum or a beverage.

In some embodiments, the aerosol generation substrate is a liquid phase configured to be atomized by any one of a heating atomizer, an ultrasonic atomizer, an air compression atomizer or a press-type spraying device to generate an aerosol.

In some embodiments, the aerosol generation substrate is a solid phase configured to generate a smokable aerosol when heated below an ignition point.

BRIEF DESCRIPTION OF DRAWINGS

One or more embodiments are illustrated by corresponding pictures in the accompanying drawings, and these exemplary descriptions do not constitute a limitation to the embodiments.

DESCRIPTION OF EMBODIMENTS

Figure 1:
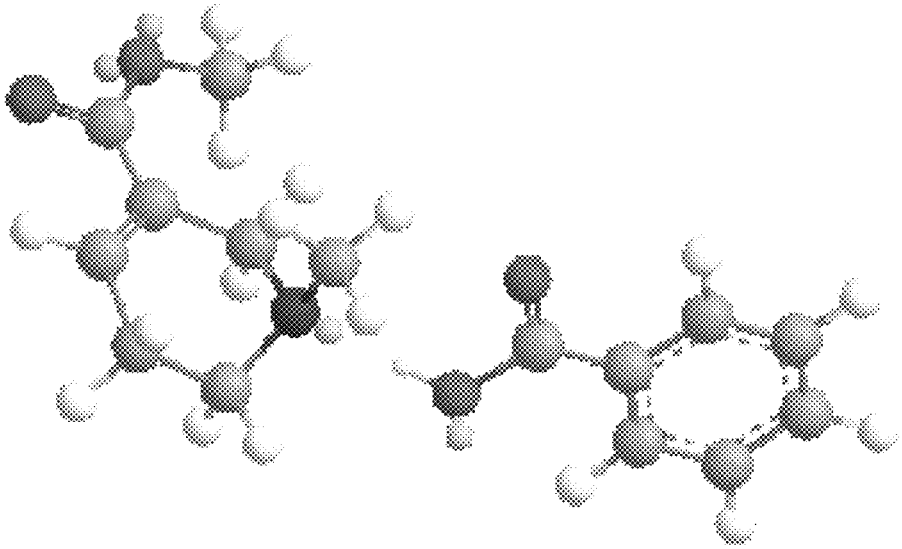
FIG. 1 is a schematic diagram of a 3D molecular structural formula of an arecoline salt according to an implementation of this application.

This application will be further described with reference to the following embodiments.

Implementation 1

Implementation 1 of this application provides an arecoline salt. The arecoline salt is a benzoate of arecoline, with a structural formula shown as follows:

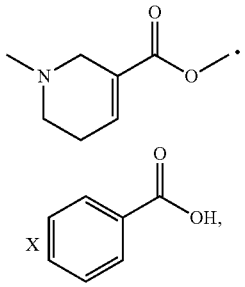

where X is a molar ratio of arecoline to benzoic acid.

In some embodiments, X has a value of $0<X\leq10$, preferably $0<X\leq8$, further preferably $0<X\leq6$, further preferably $0<X\leq5$, further preferably $0<X\leq3$, and further preferably $0<X\leq2$.

In some embodiments, the arecoline salt has a structural formula as follows:

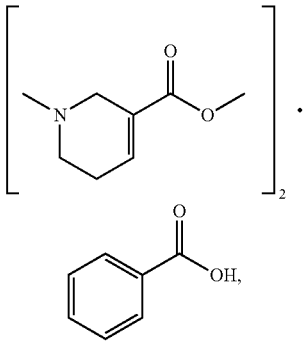

that is, the arecoline and the benzoic acid have a molar ratio of 0.5.

In some embodiments, the arecoline salt has a structural formula as follows:

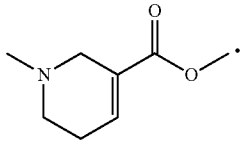

-continued

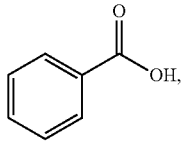

that is, the arecoline and the benzoic acid has a molar ratio of 1.

In some embodiments, the arecoline salt has a structural formula as follows:

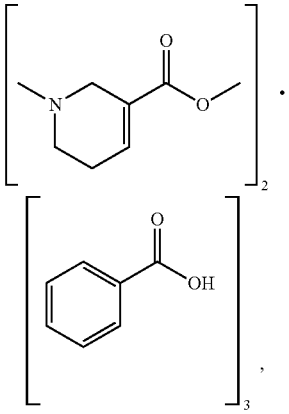

that is, the arecoline and the benzoic acid has a molar ratio of 1.5.

In some embodiments, the arecoline salt has a structural formula as follows:

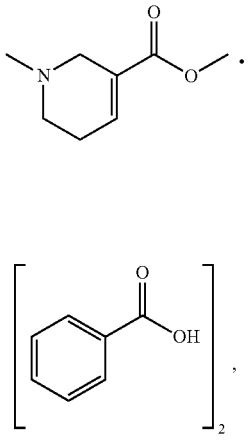

that is, the arecoline and the benzoic acid has a molar ratio of 2.

Implementation 2

Implementation 2 of this application provides a preparation method for an arecoline salt, the method includes the following steps: placing arecoline in a reactor, adding benzoic acid under stirring and heating for dissolution to obtain the arecoline salt;

the prepared arecoline salt has a structural formula as follows:

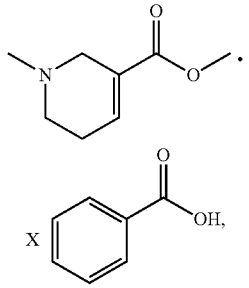

where X is a molar ratio of the arecoline to the benzoic acid.

In some embodiments, the heating is carried out at 20-100° C., preferably 20-80° C., further preferably 40-80° C., further preferably 50-80° C., and further preferably 50-70° C.

In some embodiments, X has a value of $0<X\leq10$, preferably $0<X\leq8$, further preferably $0<X\leq6$, further preferably $0<X\leq5$, further preferably $0<X\leq3$, and further preferably $0<X\leq2$.

In one example, arecoline is placed in a reactor, then benzoic acid is added at a molar ratio of the arecoline to the benzoic acid of 0.5, and heated to 50° C. under stirring for dissolution to obtain an arecoline salt.

The prepared arecoline salt has a structural formula as follows:

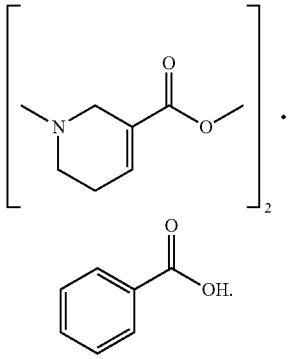

In one example, arecoline is placed in a reactor, then benzoic acid is added at a molar ratio of the arecoline to the benzoic acid of 1, and heated to 60° C. under stirring for dissolution to obtain an arecoline salt.

The prepared arecoline salt has a structural formula as follows:

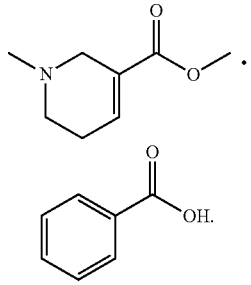

In one example, arecoline is placed in a reactor, then benzoic acid is added at a molar ratio of the arecoline to the benzoic acid of 1.5, and heated to 65° C. under stirring for dissolution to obtain an arecoline salt.

The prepared arecoline salt has a structural formula as follows:

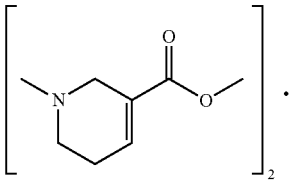

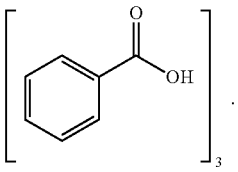

In one example, arecoline is placed in a reactor, then benzoic acid is added at a molar ratio of the arecoline to the benzoic acid of 2, and heated to 70° C. under stirring for dissolution to obtain an arecoline salt.

The prepared arecoline salt has a structural formula as follows:

,

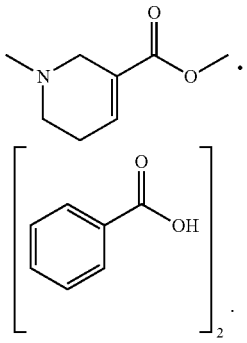

Implementation 3

Implementation 3 of this application provides a preparation method for an arecoline salt, the method includes the following steps:

dissolving arecoline hydrobromide in water to obtain an aqueous arecoline hydrobromide solution;

adjusting the aqueous arecoline hydrobromide solution to an alkalinity, and extracting with an organic solvent to obtain an organic solvent layer and a water layer; and adding benzoic acid to the organic solvent layer for dissolution to obtain an arecoline salt;

the arecoline salt has a structural formula as follows:

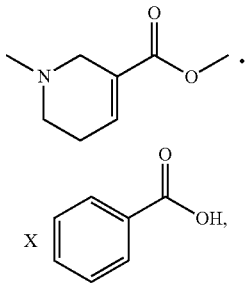

where X is a molar ratio of the arecoline to the benzoic acid.

In some embodiments, the preparation method further includes the following steps: adding water to the organic solvent layer for back extraction, and adjusting a water phase to an alkalinity to obtain a secondary organic solvent layer and a water layer; and adding benzoic acid to the secondary organic solvent layer for dissolution to obtain an arecoline salt.

In some embodiments, the alkalinity is that the adjusted water phase has a pH value of 7-10, preferably 7-9.5, further preferably 7-9, further preferably 7.5-9, and further preferably 8-9.

In some embodiments, after the secondary organic solvent layer is dried, benzoic acid is added for dissolution to obtain an arecoline salt.

In some embodiments, a desiccant is selected from the group consisting of at least one of phosphorus pentoxide, silica gel, caustic soda, lime, soda lime, anhydrous calcium chloride, anhydrous sodium sulfate and anhydrous magnesium sulfate; preferably anhydrous sodium sulfate.

Specifically, taking ethyl acetate as an example, because a small amount of water can be dissolved in ethyl acetate, but the water contains impurities such as Na+, Br— and OH—, it is necessary to remove the water from the organic solvent. Anhydrous sodium sulfate, used as a moisture scavenger, can bind with water to form crystal water.

The comparison of residual bromine before and after adding anhydrous sodium sulfate is shown in the following table.

| Solvent | Added? | Test intensity by AFS | Residual bromine |
|---|---|---|---|
| $Na_2SO_4$ | No | 63.1 | ≈500 ppm |
| | Yes | 6.7 | <10 ppm |

In some embodiments, the obtained arecoline salt is concentrated and dried to improve purity of the arecoline salt.

Specifically, the arecoline salt obtained by the above preparation process has a yield of about 90%, with a lower loss rate, and a higher scale-up loss rate. The arecoline salt has a purity of about 95%, and the main impurity is the residual organic solvent, such as ethyl acetate. After concentration and drying, the purity can reach more than 99%.

In some embodiments, the adjusted aqueous arecoline hydrobromide solution has a pH value of 7-10, preferably 7-9.5, further preferably 7-9, further preferably 7.5-9, and further preferably 8-9.

Specifically, the principle of the preparation process is to change dissociative alkaloids into free alkaloids by adjusting the pH value of the solution, and to achieve the separation effect based on different distribution coefficients of the free alkaloids in water and the organic solvent. According to the preliminary experiment, the pH value of the aqueous arecoline hydrobromide solution is neutral. If the pH value is not adjusted, the free alkaloids will be less and the extraction rate will be lower. When the pH value is adjusted to above 10, the extraction rate is not significantly improved, and the alkalinity is too high, which increases the risk of residual NaOH. Therefore, it is appropriate to adjust the pH value to 8-9. In addition, during the back extraction, it is also necessary to adjust the pH value, otherwise, the yield is low.

In some embodiments, the organic solvent is selected from the group consisting of at least one of:

ethyl acetate, benzene, toluene, xylene, petroleum ether, methyl ether, ethyl ether, methyl tert-butyl ether, dichloromethane, trichloromethane, tetrahydrofuran and n-butyl alcohol; preferably ethyl acetate.

In some embodiments, X has a value of $0<X\leq10$, preferably $0<X\leq8$, further preferably $0<X$ 6, further preferably $0<X$ 5, further preferably $0<X\leq3$, and further preferably $0<X\leq2$.

In one example, arecoline hydrobromide is dissolved in water to obtain an aqueous arecoline hydrobromide solution; sodium hydroxide is added to adjust the pH value of the aqueous arecoline hydrobromide solution to 8-9 before extracting with ethyl acetate to obtain an ethyl acetate layer and a water layer; then water is added to the ethyl acetate layer for back extraction, and sodium hydroxide is added to adjust the pH value of the water phase to 8-9 to obtain an ethyl acetate layer and a water layer; the obtained ethyl acetate layer is dried by anhydrous sodium sulfate, and then benzoic acid is added at a molar ratio of arecoline to benzoic acid of 1 for dissolution to obtain an arecoline salt.

The prepared arecoline salt has a structural formula as follows:

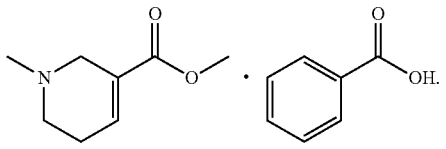

Physicochemical Analysis

The arecoline salt prepared by the preparation method in this example is a viscous yellow oily substance, which darkens slowly when placed at room temperature.

Figure 2:
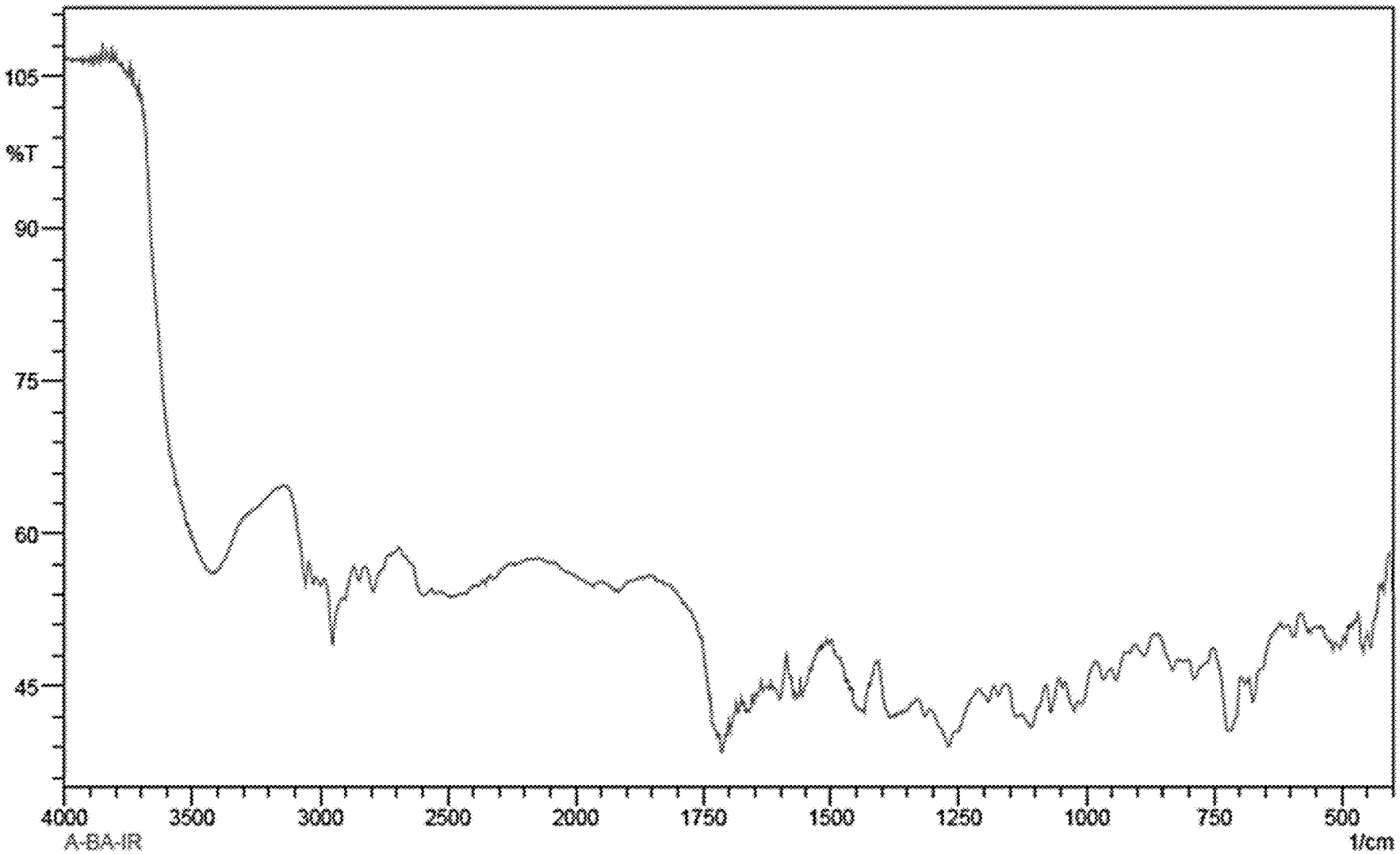
FIG. 2 is a schematic diagram of an infrared spectrogram of an arecoline salt according to an implementation of this application.
Figure 3:
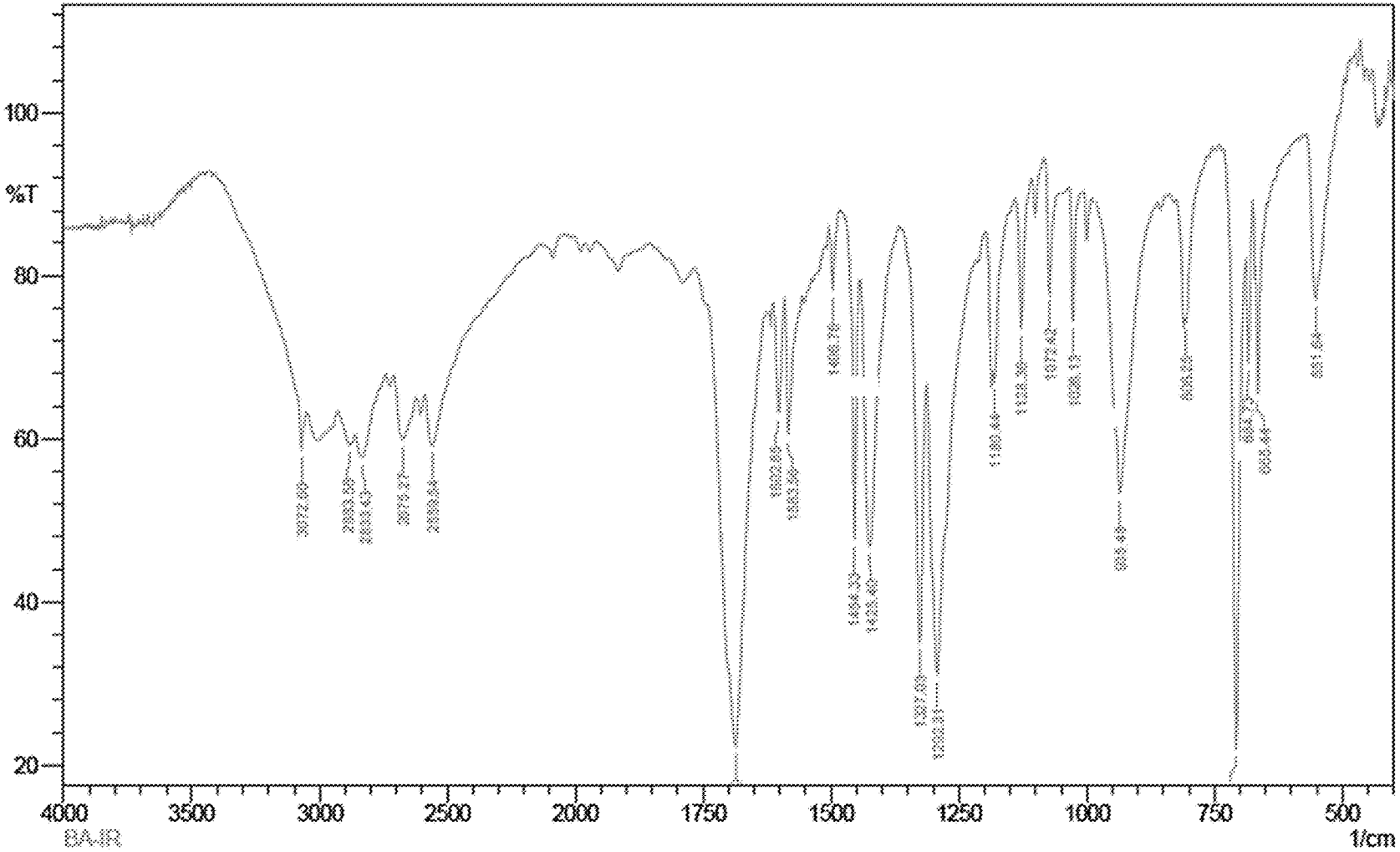
FIG. 3 is a schematic diagram of an infrared spectrogram of benzoic acid according to an implementation of this application.
Figure 4:
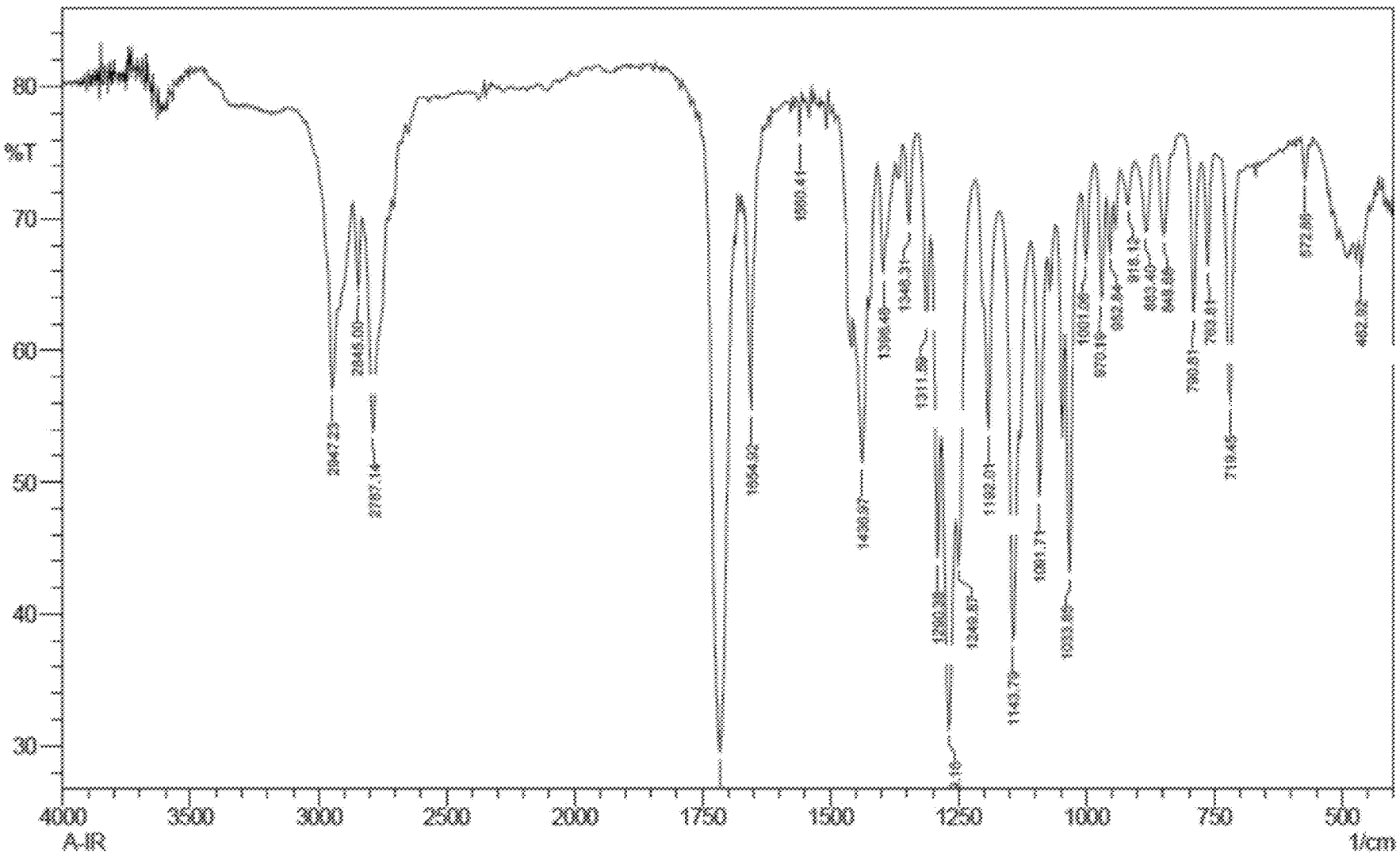
FIG. 4 is a schematic diagram of an infrared spectrogram of arecoline according to an implementation of this application.
Figure 5:
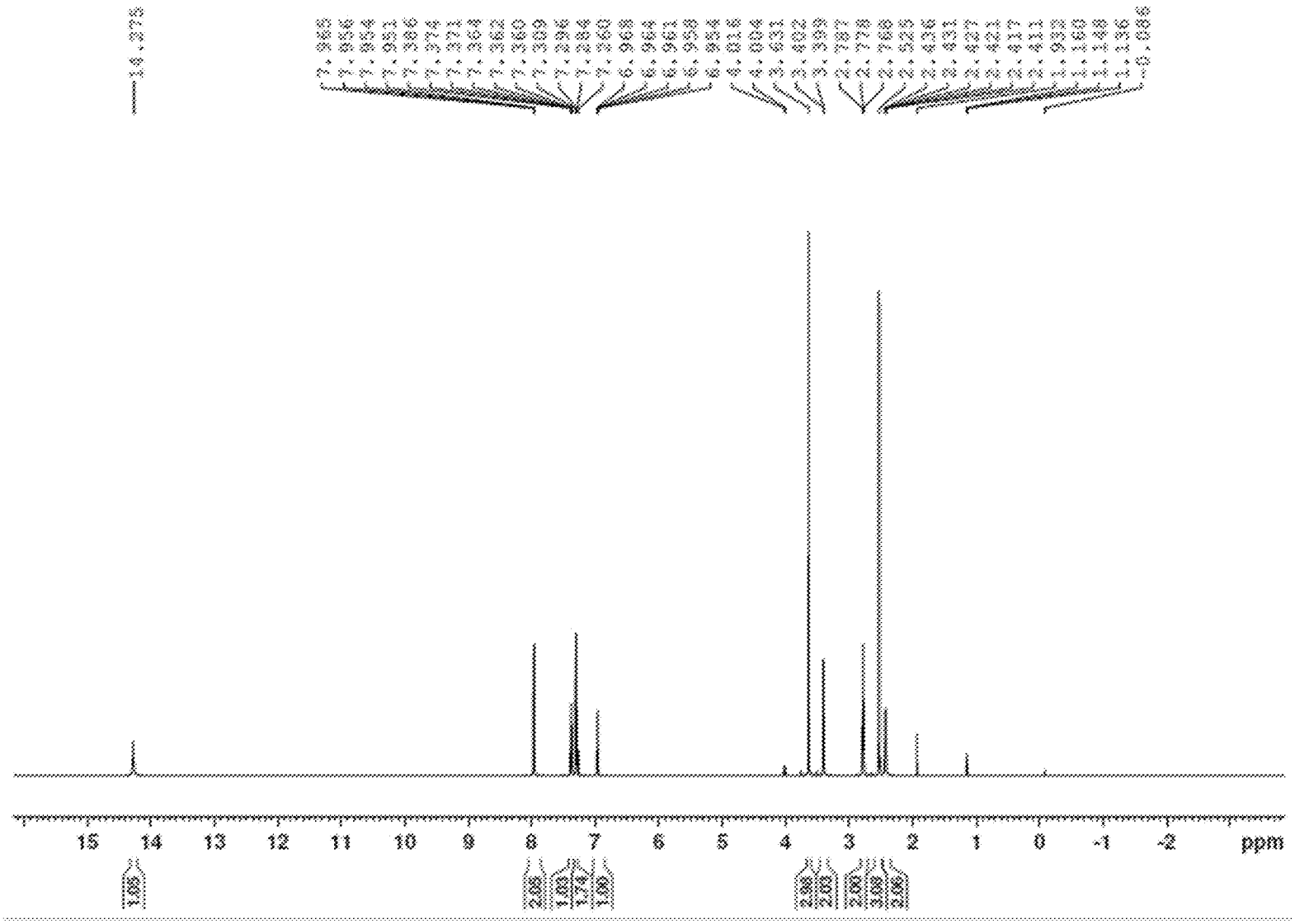
FIG. 5 is a schematic diagram of HNMR spectra of an arecoline salt according to an implementation of this application.
Figure 6:
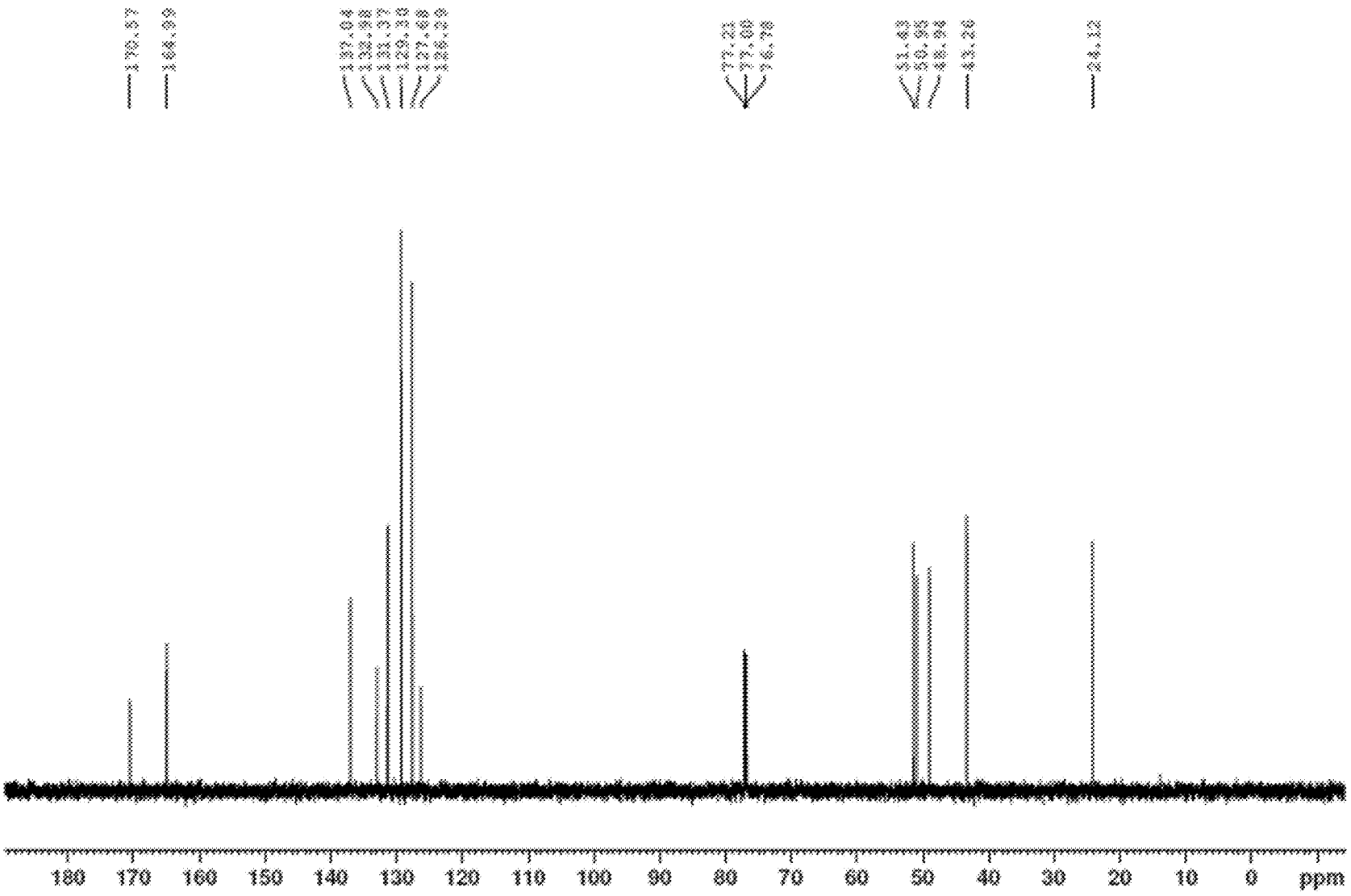
FIG. 6 is a schematic diagram of CNMR spectra of an arecoline salt according to an implementation of this application.

FIG. 1 is a schematic diagram of a 3D molecular structural formula of an arecoline salt prepared by the preparation method in this example;

FIG. 2 is a schematic diagram of an infrared spectrogram of an arecoline salt prepared by the preparation method in this example;

FIG. 3 is a schematic diagram of an infrared spectrogram of benzoic acid;

FIG. 4 is a schematic diagram of an infrared spectrogram of arecoline;

FIG. 5 is a schematic diagram of HNMR spectra of an arecoline salt prepared by the preparation method in this example; and FIG. 6 is a schematic diagram of CNMR spectra of an arecoline salt prepared by the preparation method in this example.

In one example, arecoline hydrobromide is dissolved in water to obtain an aqueous arecoline hydrobromide solution; sodium hydroxide is added to adjust the pH value of the aqueous arecoline hydrobromide solution to 8-9 before extracting with dichloromethane to obtain a dichloromethane layer and a water layer; then water is added to the dichloromethane layer for back extraction, and sodium hydroxide is added to adjust the pH value of the water phase to 8-9 to obtain a dichloromethane layer and a water layer; the obtained dichloromethane layer is dried by anhydrous magnesium sulfate, and then benzoic acid is added at a molar ratio of arecoline to benzoic acid of 0.5 for dissolution to obtain an arecoline salt.

The prepared arecoline salt has a structural formula as follows:

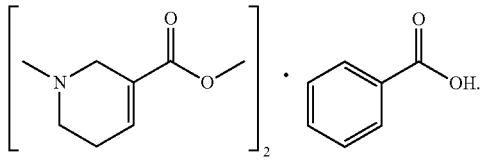

A schematic diagram of a 3D molecular structural formula, a schematic diagram of an infrared spectrogram, a schematic diagram of HNMR spectra and a schematic diagram of CNMR spectra of the arecoline salt prepared by the preparation method in this example are similar to those shown in FIG. 1 to FIG. 6. Therefore, these schematic diagrams can be understood with reference to FIG. 1 to FIG. 6.

In one example, arecoline hydrobromide is dissolved in water to obtain an aqueous arecoline hydrobromide solution; sodium hydroxide is added to adjust the pH value of the aqueous arecoline hydrobromide solution to 7-9 before extracting with ethyl acetate to obtain an ethyl acetate layer and a water layer; then water is added to the ethyl acetate layer for back extraction, and sodium hydroxide is added to adjust the pH value of the water phase to 7-9 to obtain an ethyl acetate layer and a water layer; the obtained ethyl acetate layer is dried by anhydrous sodium sulfate, and then benzoic acid is added at a molar ratio of arecoline to benzoic acid of 1.5 for dissolution to obtain an arecoline salt.

The prepared arecoline salt has a structural formula as follows:

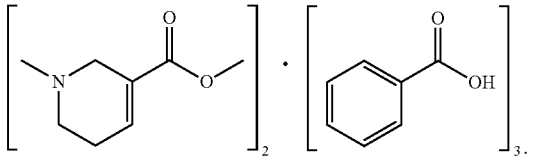

A schematic diagram of a 3D molecular structural formula, a schematic diagram of an infrared spectrogram, a schematic diagram of HNMR spectra and a schematic diagram of CNMR spectra of the arecoline salt prepared by the preparation method in this example are similar to those shown in FIG. 1 to FIG. 6. Therefore, these schematic diagrams can be understood with reference to FIG. 1 to FIG. 6.

In one example, arecoline hydrobromide is dissolved in water to obtain an aqueous arecoline hydrobromide solution; sodium hydroxide is added to adjust the pH value of the aqueous arecoline hydrobromide solution to 7-10 before extracting with ethyl acetate to obtain an ethyl acetate layer and a water layer; then water is added to the ethyl acetate layer for back extraction, and sodium hydroxide is added to adjust the pH value of the water phase to 7-10 to obtain an ethyl acetate layer and a water layer; the obtained ethyl acetate layer is dried by anhydrous sodium sulfate, and then benzoic acid is added at a molar ratio of arecoline to benzoic acid of 2 for dissolution to obtain an arecoline salt.

The prepared arecoline salt has a structural formula as follows:

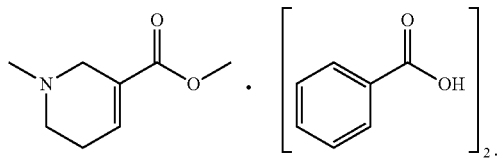

A schematic diagram of a 3D molecular structural formula, a schematic diagram of an infrared spectrogram, a schematic diagram of HNMR spectra and a schematic diagram of CNMR spectra of the arecoline salt prepared by the preparation method in this example are similar to those shown in FIG. 1 to FIG. 6. Therefore, these schematic diagrams can be understood with reference to FIG. 1 to FIG. 6.

Implementation 4

Implementation 4 of this application provides an application of the arecoline salt in preparing an aerosol generation substrate.

For a structural formula and a preparation method of the arecoline salt, refer to the contents of the above implementations, and details are not described herein again.

In some embodiments, when the aerosol generation substrate is prepared, the arecoline salt has a mass percentage of 0.2-15%, preferably 1-15%, further preferably 2-15%, further preferably 2-10%, further preferably 2-5%, and further preferably 2-4%, based on total mass of the aerosol generation substrate.

In some embodiments, when the aerosol generation substrate is prepared, objects added to the arecoline salt include a solvent.

In some embodiments, the solvent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, the solvent includes glycerol, and the glycerol has a mass percentage of 0-90%.

In some embodiments, the solvent includes propylene glycol, and the propylene glycol has a mass percentage of 9-99.8%.

In some embodiments, objects added to the arecoline salt further include a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, objects added to the arecoline salt do not include nicotine and/or nicotine salts.

Implementation 5

Implementation 5 of this application provides an aerosol generation substrate including the arecoline salt and a solvent.

For a structural formula and a preparation method of the arecoline salt, refer to the contents of the above implementations, and details are not described herein again.

In some embodiments, the arecoline salt has a mass percentage of 0.2-15%, preferably 1-15%, further preferably 2-15%, further preferably 2-10%, further preferably 2-5%, and further preferably 2-4%, based on total mass of the aerosol generation substrate.

In some embodiments, when the aerosol generation substrate is atomized into an aerosol, at least about 80% of the arecoline salt is in the aerosol.

In some embodiments, when the aerosol generation substrate is atomized into an aerosol, the arecoline salt has a mass percentage of 0.1-12%, preferably 0.8-12%, further preferably 1.5-12%, further preferably 1.5-8%, further preferably 1.5-4.5%, and further preferably 1.5-3.5%, based on total mass of the aerosol.

In some embodiments, the solvent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, the solvent includes glycerol, and the glycerol in the aerosol generation substrate has a mass percentage of 0-90%.

In some embodiments, the solvent includes propylene glycol, and the propylene glycol in the aerosol generation substrate has a mass percentage of 9-99.8%.

In some embodiments, the aerosol generation substrate further includes a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, the aerosol generation substrate does not include nicotine and/or nicotine salts.

I. Comparison Test on Atomization

Test Method:

An arecoline salt (benzoate of arecoline) is used, and a mixture of glycerol and propylene glycol at a mass ratio of 1:1 is selected as a solvent. Arecoline hydrobromide (hydrobromide of arecoline) is used in a comparative example, and a mixture of glycerol and propylene glycol at a mass ratio of 1:1 is selected as a solvent.

A smoking machine is used for smoking in accordance with international standards, and a Cambridge filter is used to collect an aerosol atomized from an aerosol generation substrate. The mass of the arecoline salt in the aerosol is tested to be m1. Then, the mass of the arecoline salt in the remaining aerosol generation substrate is tested to be m2, the mass of total arecoline salt in the aerosol generation substrate is m0, and the conversion rate $k=m1/(m0-m2)$ is calculated.

For international standards involved, refer to:

CORESTA RECOMMENDED METHOD N° 81, Afnor standardization XP D90-300-3, International Standard ISO 20768:2018 and PD CEN/TR 17236:2018.

Parameters for puffing an e-cigarette are as follows:

| | |
|---|---|
| Puff Duration | 3.0 s ± 0.1 s |
| Puff Volume | 55 mL ± 0.3 mL |
| Puff Frequency | 30 s ± 0.5 s |
| Puff of Each Group | 20 |
| Group Interval Time | 300 s ± 120 s |
| Maximum Flow | 18.5 mL/s ± 0.1 mL/s |
| Pressure Drop | <50 hPa |
| Group | 5 |
| Total Number of Puff | 100 |
| Total Duration of Atomization | 300 s |

Test Results for Arecoline Salt

| Embodiment | Content of arecoline salt (%) | k | Content of arecoline salt in aerosol (%) |
|---|---|---|---|
| 1 | 1% | 88% | 0.88% |
| 2 | 3% | 85% | 2.55% |
| 3 | 5% | 90% | 4.50% |
| 4 | 10% | 80% | 8.00% |
| 5 | 15% | 81% | 12.15% |

Test Results in Comparative Examples

| Embodiment | Content of arecoline hydrobromide (%) | k | Content of arecoline hydrobromide in aerosol (%) |
|---|---|---|---|
| 1 | Arecoline hydrobromide (1%) | 79% | 0.8% |
| 2 | Arecoline hydrobromide (3%) | 75% | 2.2% |
| 3 | Arecoline hydrobromide (5%) | 62% | 3.1% |
| 4 | Arecoline hydrobromide (10%) | 56% | 5.6% |
| 5 | Arecoline hydrobromide (15%) | 50% | 7.5% |

It is clear from the test results that the arecoline salt has a conversion rate obviously higher than that of the arecoline hydrobromide, and the conversion rate is relatively stable at different concentrations (1-15%), and the arecoline can be completely atomized normally.

II. Comparison Test on Puff Experience

An arecoline salt and an arecoline hydrobromide of the same content (3%) are selected for puff experience tests, and scores are given from 0 to 5 in terms of pleasure, increased heart rate, ruddy face, body fever, slight sweating and so on by evaluation of multiple smokers.

Test Results of Puff Experience Experiment

| Title | Pleasure | Increased heart rate | Ruddy face, body fever, slight sweating |
|---|---|---|---|
| 3% arecoline salt | 4 | 4 | 5 |
| 3% arecoline hydrobromide | 2 | 1 | 2 |

It is clear from the test results that the arecoline salt of the same content (3%) is obviously superior to the arecoline hydrobromide in terms of puff experience in pleasure, increased heart rate, ruddy face, body fever and slight sweating.

Implementation 6

Implementation 6 of this application provides an aerosol generating system including a atomizer and the aerosol generation substrate according to implementation 5;

the atomizer is configured to atomize the aerosol generation substrate to form an aerosol.

In some embodiments, the atomizer is a heating atomizer.

In some embodiments, the atomizer is an ultrasonic atomizer.

In some embodiments, the aerosol generation substrate includes an arecoline salt, glycerol and propylene glycol.

In some embodiments, the ultrasonic atomizer has an oscillation frequency greater than 1 MHz.

In some embodiments, the atomizer is an air compression atomizer or a press-type spraying device.

In some embodiments, the aerosol generation substrate includes an arecoline salt, ethyl alcohol and water.

Implementation 7

Implementation 7 of this application provides an application of the arecoline salt in manufacturing an aerosol-generating article.

The aerosol-generating article is configured to be heated to generate a smokable aerosol. For a structural formula and a preparation method of the arecoline salt, refer to the contents of the above implementations, and details are not described herein again.

In some embodiments, when the aerosol-generating article is manufactured, the arecoline salt has a mass percentage of 0.2-15%, preferably 1-15%, further preferably 2-15%, further preferably 2-10%, further preferably 2-5%, further preferably 2-4%, and more preferably 3-4%, based on total mass of raw materials of the aerosol-generating article.

In some embodiments, when the aerosol-generating article is manufactured, objects added to the arecoline salt include an atomizing agent, an adhesive and a plant fiber.

In some embodiments, when the aerosol-generating article is manufactured, the atomizing agent has a mass percentage of 5-30%, preferably 10-30%, further preferably 10-25%, and further preferably 15-25%, based on total mass of raw materials of the aerosol-generating article.

In some embodiments, the atomizing agent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, when the aerosol-generating article is manufactured, the adhesive has a mass percentage of 1-20%, preferably 1-15%, further preferably 1-10%, further preferably 3-10%, and further preferably 5-10%, based on total mass of raw materials of the aerosol-generating article.

In some embodiments, the adhesive is selected from the group consisting of at least one of:

carboxymethyl cellulose, hydroxypropyl methyl cellulose, polyvinyl alcohol, rosin, xanthan gum, Arabic gum, guar gum, chitosan, pectin, locust bean gum, starch, sodium alginate or shellac.

In some embodiments, when the aerosol-generating article is manufactured, the plant fiber has a mass percentage of 40-80%, preferably 40-70%, further preferably 50-70%, further preferably 50-65%, and further preferably 50-60%, based on total mass of raw materials of the aerosol-generating article.

In some embodiments, the plant fiber is selected from the group consisting of at least one of:

areca nut fiber, wood pulp fiber, hemp pulp fiber, cotton pulp fiber, bagasse pulp fiber, bamboo pulp fiber or coconut pulp fiber.

In some embodiments, objects added to the arecoline salt further include a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, objects added to the arecoline salt do not include tobacco components.

In some embodiments, a method for manufacturing the aerosol-generating article includes one of paper-making process, dry paper-making process, slurry process and roller-formation process.

Implementation 8

Implementation 8 of this application provides an aerosol-generating article obtained from raw materials including the arecoline salt, an atomizing agent, an adhesive and a plant fiber.

The aerosol-generating article is configured to be heated to generate a smokable aerosol. For a structural formula and a preparation method of the arecoline salt, refer to the contents of the above implementations, and details are not described herein again.

In some embodiments, the arecoline salt has a mass percentage of 0.2-15%, preferably 1-15%, further preferably 2-15%, further preferably 2-10%, further preferably 2-5%, further preferably 2-4%, and more preferably 3-4%, based on total mass of the raw materials.

In some embodiments, the atomizing agent has a mass percentage of 5-30%, preferably 10-30%, further preferably 10-25%, and further preferably 15-25%, based on total mass of the raw materials.

In some embodiments, the atomizing agent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, the adhesive has a mass percentage of 1-20%, preferably 1-15%, further preferably 1-10%, further preferably 3-10%, and further preferably 5-10%, based on total mass of the raw materials.

In some embodiments, the adhesive is selected from the group consisting of at least one of:

carboxymethyl cellulose, hydroxypropyl methyl cellulose, polyvinyl alcohol, rosin, xanthan gum, Arabic gum, guar gum, chitosan, pectin, locust bean gum, starch, sodium alginate or shellac.

In some embodiments, the plant fiber has a mass percentage of 40-80%, preferably 40-70%, further preferably 50-70%, further preferably 50-65%, and further preferably 50-60%, based on total mass of the raw materials.

In some embodiments, the plant fiber is selected from the group consisting of at least one of:

areca nut fiber, wood pulp fiber, hemp pulp fiber, cotton pulp fiber, bagasse pulp fiber, bamboo pulp fiber or coconut pulp fiber.

In some embodiments, the raw materials further include a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, the raw materials do not include tobacco components.

Embodiment 1

A heat-not-burn cigarette is prepared according to the following steps:

Step 1: preparation of a sheet substrate. Solid residues of an areca nut extract are selected and soaked in water at 60-80° C. for 0.5-2 h before filtering, the filtered solid is pulped to obtain a slurry, then 50-70 parts of slurry and 3-10 parts of solid adhesive are measured by weight and mixed well, and then a resulting mixed slurry is sent to a paper machine for molding and drying until the moisture content is about 10-15% to obtain a sheet substrate;

the solid adhesive may be one or more of carboxymethyl cellulose, hydroxypropyl methyl cellulose, polyvinyl alcohol, rosin, xanthan gum, Arabic gum, guar gum, chitosan, pectin, locust bean gum, starch, sodium alginate or shellac.

Step 2: preparation of a coating fluid. 1-50 parts of arecoline salt, 2-20 parts of perfume and 40-80 parts of atomizing agent are measured by weight, and mixed well to obtain a coating fluid;

the atomizing agent is a mixture of glycerol and propylene glycol at a mixing ratio of 3-5:1.

Step 3: coating of the sheet substrate. The coating fluid obtained in the step 2 is weighed at 25-40% of the weight of the sheet substrate obtained in the step 1, then sprayed onto the sheet substrate, and allowed to stand under a constant temperature and a constant humidity for 40-60 h to obtain a plant sheet containing the arecoline salt.

Step 4: preparation of a heat-not-burn cigarette. the plant sheet obtained in the step 3 is made into a cigarette stick by size, and the cigarette stick is connected to a filter tip to obtain a heat-not-burn cigarette containing the arecoline salt.

The heat-not-burn cigarette prepared by the above preparation method is heated by an aerosol generation apparatus (by means of resistance heating), and surface temperature of a heating element in a working state is tested by an infrared thermal imager. Test results are shown in the following table.

| | Puff duration (temperature) | | |
|---|---|---|---|
| Component | 1 s (° C.) | 2 s (° C.) | 3 s (° C.) |
| Arecoline salt | 153.1 | 228.3 | 241.1 |

It is clear from the test results that the arecoline salt in the cigarette can be atomized at 150-250° C. and generate a smokable aerosol.

The heat-not-burn cigarette prepared by the above preparation method is compared with an ordinary heat-not-burn cigarette for smoking and sensory quality evaluation: arecoline can be taken in from the heat-not-burn cigarette prepared by the above preparation method, and the heat-not-burn cigarette prepared by the above preparation method can produce a similar effect of chewing areca nuts, with low irritation.

Implementation 9

Implementation 9 of this application provides an application of the arecoline salt in preparing a liquid composition for a filter capsule; where the filter capsule includes a fragile shell and the liquid composition in the fragile shell. For a structural formula and a preparation method of the arecoline salt, refer to the contents of the above implementations, and details are not described herein again.

In some embodiments, the arecoline salt has a mass percentage of 0.2-15%, preferably 1-15%, further preferably 2-15%, further preferably 2-10%, further preferably 2-5%, further preferably 2-4%, and more preferably 3-4%, based on total mass of the liquid composition.

In some embodiments, when the liquid composition is prepared, objects added to the arecoline salt include an atomizing agent.

In some embodiments, the atomizing agent has a mass percentage of 5-30%, preferably 10-30%, further preferably 10-25%, and further preferably 15-25%, based on total mass of the liquid composition.

In some embodiments, the atomizing agent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, objects added to the arecoline salt further include a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, objects added to the arecoline salt do not include nicotine and/or nicotine salts.

In some embodiments, the filter capsule is implanted in the aerosol-generating article.

In some embodiments, raw materials of the aerosol-generating article do not include tobacco components.

Implementation 10

Implementation 10 of this application provides a filter capsule including a fragile shell and a liquid composition in the fragile shell;

the liquid composition includes the arecoline salt and an atomizing agent. For a structural formula and a preparation method of the arecoline salt, refer to the contents of the above implementations, and details are not described herein again.

In some embodiments, the arecoline salt has a mass percentage of 0.2-15%, preferably 1-15%, further preferably 2-15%, further preferably 2-10%, further preferably 2-5%, further preferably 2-4%, and more preferably 3-4%, based on total mass of the liquid composition.

In some embodiments, the atomizing agent has a mass percentage of 5-30%, preferably 10-30%, further preferably 10-25%, and further preferably 15-25%, based on total mass of the liquid composition.

In some embodiments, the atomizing agent is selected from the group consisting of at least one of:

1,2-propanediol, 1,3-propanediol, glycerol, polyethylene glycol 200, polyethylene glycol 400, dipropylene glycol ether, ethanol, water, triethyl citrate, triacetin, caprylic capric triglyceride, isopropyl alcohol, sweet orange oil, lemon oil, peppermint oil, palm oil, peanut oil, corn oil or salad oil.

In some embodiments, the liquid composition further includes a flavoring agent.

In some embodiments, the flavoring agent is selected from the group consisting of at least one of:

nerol, trans-2-hexenol, linalool, benzyl alcohol, 1-hexanol, leaf alcohol, alpha-terpineol, citronellol, beta-phenylethanol, linalool oxide, geraniol, isoamyl alcohol, octanol, hexanol, decanol, cinnamyl alcohol, heptanol, eugenol, maltol, ethyl maltol, thymol, isoeugenol, 2-methylbutyric acid, malic acid, n-valeric acid, n-hexanoic acid, edible acetic acid, n-caprylic acid, strawberry acid, butyric acid, citric acid, propionic acid, 3-methylvaleric acid, isovaleric acid, isoamyl acetate, amyl formate, geranyl formate, butyl formate, benzyl formate, formicacidhexenester, gamma-decanolactone, delta-nonalactone, gamma-octalactone, gamma-heptalactone, gamma-Undecalactone, delta-dodecalactone, benzaldehyde, strawberry aldehyde, cinnamaldehyde, furfural, citral, acetaldehyde, 3-methylthiopropanal, natural 3-mercapto-2-methylpentanal, isobutyraldehyde, trans-2-octenal, trans-2-nonenal, trans-2-decenal, trans, trans-2,4-heptadienal, 2,5-dimethylpyrazine, 2-acetylfuran, 2-ethyl-3 (5 or 6)-dimethylpyrazine, 2,3,5,6-tetramethylpyrazine, 2,3,5-trimethylpyrazine, 2-acetylpyrazine, acetophenone, beta-ionone, damascenone No. 2 (Firmenich), butanedione, alpha-ionone, acetoin (acetyl methyl carbinol), methyl heptenone, vanillin, ethyl vanillin, dihydrocoumarin, raspberry ketone, anisole, cedrol methyl ether, methyl-2-methyl-3-furyl disulfide, wintergreen oil, clove bud oil, 10-fold orange oil, Bois de rose oil, geranium oil, benzaldehyde, basil oil, ethyl vanillin, dihydrocoumarin, raspberry ketone, vanitrope, Tolu concrete, Peru concrete, oak extract, supercritical extract from espresso (water soluble), cocoa extract, coffee tincture, pandan leaf extract, vanilla extract, Labdanum concrete, orris oil or concrete, jasmine concrete, tree moss concrete (amber), tamarind extract, Zimbabwean tobacco extract, tobacco essence, burley tobacco extract, flue-cured tobacco absolute A, top note extract of flue-cured tobacco or top note extract of sun-cured tobacco.

It should be noted that the flavoring agent is not limited to the substances listed above, and any flavoring agent conforming to FEMA codes or CAS codes is applicable.

In some embodiments, the liquid composition does not include nicotine and/or nicotine salts.

Implementation 11

Implementation 11 of this application provides an aerosol-generating article including the filter capsule according to Implementation 10.

In some embodiments, raw materials of the aerosol-generating article do not include tobacco components.

In the implementation, the aerosol-generating article can be prepared by a paper-making process, a dry paper-making process, a slurry process or a roller-formation process. Specifically, refer to the contents of the above implementations for raw materials and preparation steps of the aerosol-generating article.

A filter capsule can be implanted into a filter tip section (not limited to this position) of a heat-not-burn cigarette by embedding the filter capsule in a filter stick (not limited to this technology). When in use, a smoker can break the filter capsule to take in substances such as arecoline.

It should be noted that in the implementation, there is no special restriction on components and preparation processes of the fragile shell, as well as preparation processes of the filter capsule, and techniques well known to those skilled in the art can be used.

Embodiment 1

A liquid composition in a filter capsule is prepared according to the following formula:

10 wt % arecoline salt, 80 wt % caprylic capric triglyceride and 10 wt % menthol.

Preparation method: arecoline salt of the above formula weight is weighed, then caprylic capric triglyceride and menthol are added under stirring, and mixed well to obtain the liquid composition.

The heat-not-burn cigarette containing the filter capsule according to Embodiment 1 is compared with a heat-not-burn cigarette without a filter capsule for smoking and sensory quality evaluation: arecoline can be taken in from the heat-not-burn cigarette containing the filter capsule according to Embodiment 1, and the heat-not-burn cigarette containing the filter capsule according to Embodiment 1 can produce a similar effect of chewing areca nuts, with low irritation.

Implementation 12

Implementation 12 of this application provides an application of the arecoline salt in manufacturing a chewing gum. For a structural formula and a preparation method of the arecoline salt, refer to the contents of the above implementations, and details are not described herein again.

In some embodiments, when the chewing gum is manufactured, the arecoline salt has a mass percentage of 0.02-2%, preferably 0.02-1.6%, further preferably 0.02-1.2%, further preferably 0.02-1%, further preferably 0.1-1%, further preferably 0.2-1%, and further preferably 0.4-1%, based on total mass of raw materials of the chewing gum.

In some embodiments, when the chewing gum is manufactured, objects added to the arecoline salt include a gum base.

In some embodiments, when the chewing gum is manufactured, the gum base has a mass percentage of 20-75%, preferably 20-70%, further preferably 20-60%, further preferably 20-50%, further preferably 25-50%, further preferably 30-50%, further preferably 35-50%, and further preferably 35-45%, based on total mass of raw materials of the chewing gum.

In some embodiments, objects added to the arecoline salt further include a sweetening agent.

In some embodiments, the sweetening agent is selected from the group consisting of at least one of:

white granulated sugar, rock sugar, sucrose, maltose, corn syrup, glucose syrup, fructose, maltodextrin, polydextrose, xylitol, sorbitol, maltitol, erythritol, aspartame, acesulfame, sucralose, stevioside or neotame.

In some embodiments, when the chewing gum is manufactured, the sweetening agent has a mass percentage of 20-75%, preferably 20-70%, further preferably 20-60%, further preferably 20-50%, further preferably 25-50%, further preferably 25-40%, further preferably 25-35%, and further preferably 30-35%, based on total mass of raw materials of the chewing gum.

In some embodiments, objects added to the arecoline salt further include a filler material.

In some embodiments, the filler material is selected from the group consisting of at least one of:

sodium carbonate, sodium bicarbonate, potassium carbonate, calcium carbonate, dicalcium phosphate or sodium dihydrogen phosphate.

In some embodiments, when the chewing gum is manufactured, the filler material has a mass percentage of 0.03-23%, preferably 0.03-20%, further preferably 0.03-15%, further preferably 0.03-10%, further preferably 0.5-10%, further preferably 1-10%, further preferably 1.5-10%, further preferably 2-8%, and further preferably 2-6%, based on total mass of raw materials of the chewing gum.

In some embodiments, objects added to the arecoline salt further include a flavor.

In some embodiments, the flavor is selected from the group consisting of at least one of:

mint, spearmint, cinnamon, borneol or essence.

Implementation 13

Implementation 13 of this application provides a chewing gum obtained from raw materials including the arecoline salt and a gum base. For a structural formula and a preparation method of the arecoline salt, refer to the contents of the above implementations, and details are not described herein again.

In some embodiments, the arecoline salt has a mass percentage of 0.02-2%, preferably 0.02-1.6%, further preferably 0.02-1.2%, further preferably 0.02-1%, further preferably 0.1-1%, further preferably 0.2-1%, and further preferably 0.4-1%, based on total mass of the raw materials.

In some embodiments, the gum base has a mass percentage of 20-75%, preferably 20-70%, further preferably 20-60%, further preferably 20-50%, further preferably 25-50%, further preferably 30-50%, further preferably 35-50%, and further preferably 35-45%, based on total mass of the raw materials.

In some embodiments, the raw materials further include a sweetening agent.

In some embodiments, the sweetening agent is selected from the group consisting of at least one of:

white granulated sugar, rock sugar, sucrose, maltose, corn syrup, glucose syrup, fructose, maltodextrin, polydextrose, xylitol, sorbitol, maltitol, erythritol, aspartame, acesulfame, sucralose, stevioside or neotame.

In some embodiments, the sweetening agent has a mass percentage of 20-75%, preferably 20-70%, further preferably 20-60%, further preferably 20-50%, further preferably 25-50%, further preferably 25-40%, further preferably 25-35%, and further preferably 30-35%, based on total mass of the raw materials.

In some embodiments, the raw materials further include a filler material.

In some embodiments, the filler material is selected from the group consisting of at least one of:

sodium carbonate, sodium bicarbonate, potassium carbonate, calcium carbonate, dicalcium phosphate or sodium dihydrogen phosphate.

In some embodiments, the filler material has a mass percentage of 0.03-23%, preferably 0.03-20%, further preferably 0.03-15%, further preferably 0.03-10%, further preferably 0.5-10%, further preferably 1-10%, further preferably 1.5-10%, further preferably 2-8%, and further preferably 2-6%, based on total mass of the raw materials.

In some embodiments, the raw materials further include a flavor.

In some embodiments, the flavor is selected from the group consisting of at least one of:

mint, spearmint, cinnamon, borneol or essence.

Embodiment 1

A chewing gum is prepared according to the following formula:

54 wt % gum base, 23 wt % powdered sugar, 14 wt % glucose syrup, 4 wt % potassium carbonate, 3 wt % peppermint flavor, 1 wt % menthol and 1 wt % arecoline salt.

Preparation method: a gum base is heated to 70-105° C. and stirred in a blender, then powdered sugar is added while allowing to cool to 60-80° C., then a buffer pair, additives, glucose syrup and arecoline salt are added for finally rolling and molding to obtain a finished product.

Embodiment 2

A xylitol chewing gum is prepared according to the following formula:

54 wt % gum base, 23 wt % xylitol, 14 wt % non-sucrose, 4 wt % potassium carbonate, 3 wt % peppermint flavor, 1 wt % menthol and 1 wt % arecoline salt.

Preparation method: a gum base is heated to 70-105° C. and stirred in a blender, then xylitol and non-sucrose are added while allowing to cool to 60-80° C., then a buffer pair, additives and an arecoline salt are added for finally rolling and molding to obtain a finished product.

The chewing gums prepared by the above preparation methods are compared with an ordinary chewing gum for edible and sensory quality evaluation: the chewing gums prepared by the above preparation methods can produce a similar effect of chewing areca nuts, with low irritation and good taste. Because the chewing gums do not contain lime powder and cellulose, the problems of abrasion and irritation of oral mucosa and induction of oral diseases when chewing areca nuts are avoided.

Implementation 14

Implementation 14 of this application provides an application of the arecoline salt in preparing a beverage. For a structural formula and a preparation method of the arecoline salt, refer to the contents of the above implementations, and details are not described herein again.

In some embodiments, when the beverage is prepared, the arecoline salt has a mass percentage of 0.01-0.5%, preferably 0.01-0.4%, further preferably 0.01-0.3%, further preferably 0.01-0.2%, and further preferably 0.05-0.2%, based on total mass of the beverage.

In some embodiments, when the beverage is prepared, objects added to the arecoline salt include water.

In some embodiments, when the beverage is prepared, the water has a mass percentage of 75-90%, based on total mass of the beverage.

In some embodiments, when the beverage is prepared, objects added to the arecoline salt further include a functional component.

In some embodiments, the functional component is selected from the group consisting of at least one of:

concentrated momordica grosvenorii juice, natural menthol, concentrated liquorice juice, concentrated honeysuckle juice, chrysanthemum extract, kudzuvine root extract and loquat puree.

In some embodiments, the functional component has a mass percentage of 0.5-2%, based on total mass of the beverage.

In some embodiments, when the beverage is prepared, objects added to the arecoline salt further include an acidity regulator.

In some embodiments, the acidity regulator is selected from the group consisting of at least one of:

tartaric acid, malic acid, citric acid and sodium citrate.

In some embodiments, when the beverage is prepared, the acidity regulator has a mass percentage of 0.1-5%, based on total mass of the beverage.

In some embodiments, when the beverage is prepared, objects added to the arecoline salt further include a sweetening agent.

In some embodiments, the sweetening agent is selected from the group consisting of at least one of:

white granulated sugar, rock sugar, sucrose, maltose, corn syrup, glucose syrup, fructose, maltodextrin, polydextrose, xylitol, sorbitol, maltitol, erythritol, aspartame, acesulfame, sucralose, stevioside or neotame.

In some embodiments, when the beverage is prepared, the sweetening agent has a mass percentage of 0.5-5%, based on total mass of the beverage.

In some embodiments, when the beverage is prepared, objects added to the arecoline salt further include an antioxidant.

In some embodiments, the antioxidant is selected from the group consisting of at least one of:

ascorbic acid, sodium erythorbate, vitamin C and vitamin E.

In some embodiments, when the beverage is prepared, the antioxidant has a mass percentage of 0.05-0.15%, based on total mass of the beverage.

In some embodiments, when the beverage is prepared, objects added to the arecoline salt further include a preservative.

In some embodiments, the preservative is selected from the group consisting of at least one of:

sodium benzoate, sodium sorbate, and potassium sorbate.

In some embodiments, when the beverage is prepared, the preservative has a mass percentage of 0.01-0.05%, based on total mass of the beverage.

In some embodiments, when the beverage is prepared, objects added to the arecoline salt further include an edible essence.

In some embodiments, when the beverage is prepared, the edible essence has a mass percentage of 0.5-5%, based on total mass of the beverage.

Implementation 15

Implementation 15 of this application provides a beverage obtained from raw materials including the arecoline salt and water. For a structural formula and a preparation method of the arecoline salt, refer to the contents of the above implementations, and details are not described herein again.

In some embodiments, the arecoline salt has a mass percentage of 0.01-0.5%, preferably 0.01-0.4%, further preferably 0.01-0.3%, further preferably 0.01-0.2%, and further preferably 0.05-0.2%, based on total mass of the beverage.

In some embodiments, the water has a mass percentage of 75-90%, based on total mass of the beverage.

In some embodiments, the raw materials further include a functional component.

In some embodiments, the functional component is selected from the group consisting of at least one of:

concentrated momordica grosvenorii juice, natural menthol, concentrated liquorice juice, concentrated honeysuckle juice, chrysanthemum extract, kudzuvine root extract and loquat puree.

In some embodiments, the functional component has a mass percentage of 0.5-2%.

In some embodiments, the raw materials further include an acidity regulator.

In some embodiments, the acidity regulator is selected from the group consisting of at least one of:

tartaric acid, malic acid, citric acid and sodium citrate.

In some embodiments, the acidity regulator has a mass percentage of 0.1-5%.

In some embodiments, the raw materials further include a sweetening agent.

In some embodiments, the sweetening agent is selected from the group consisting of at least one of:

white granulated sugar, rock sugar, sucrose, maltose, corn syrup, glucose syrup, fructose, maltodextrin, polydextrose, xylitol, sorbitol, maltitol, erythritol, aspartame, acesulfame, sucralose, stevioside or neotame.

In some embodiments, the sweetening agent has a mass percentage of 0.5-5%.

In some embodiments, the raw materials further include an antioxidant.

In some embodiments, the antioxidant is selected from the group consisting of at least one of:

ascorbic acid, sodium erythorbate, vitamin C and vitamin E.

In some embodiments, the antioxidant has a mass percentage of 0.05-0.15%.

In some embodiments, the raw materials further include a preservative.

In some embodiments, the preservative is selected from the group consisting of at least one of:

sodium benzoate, sodium sorbate, and potassium sorbate.

In some embodiments, the preservative has a mass percentage of 0.01-0.05%.

In some embodiments, the raw materials further include an edible essence.

In some embodiments, the edible essence has a mass percentage of 0.5-5%.

Embodiment 1

A beverage is prepared according to the following formula:

0.1 wt % arecoline salt, 88 wt % water, 1 wt % concentrated honeysuckle juice, 1 wt % concentrated liquorice juice, 2 wt % citric acid, 2 wt % sodium citrate, 3 wt % stevioside, 0.05 wt % vitamin C, 0.05 wt % sodium sorbate and 2.8 wt % edible essence.

Preparation method: the arecoline salt is fully mixed with water, concentrated honeysuckle juice, concentrated liquorice juice, citric acid, sodium citrate, stevioside, vitamin C, sodium sorbate and an edible essence to prepare a beverage.

The beverage prepared by the above preparation method retains various nutrients beneficial to human body in honeysuckle and liquorice. The beverage, rich in arecoline, areca polyphenols and other components, has a good taste, and has various effects of invigorating spleen and replenishing qi, clearing away heat and toxic materials, expelling phlegm to arrest coughing, relieving spasm and pain, and so on.

The written description discloses this application through embodiments, including the best mode, and also enables those skilled in the art to practice this application. The patentable scope of this application is defined by the claims, and may include other examples that occur to those skilled in the art. Such other examples are intended to be within the scope of the claims if they have structural elements that are not different from the literal language of the claims, or if they include equivalent structural elements without substantial differences from the literal language of the claims. All references cited herein are incorporated herein by reference to the extent that they do not cause inconsistency.

What is claimed is:

1. An arecoline salt, wherein the arecoline salt is benzoate of arecoline, with a structural formula as follows:

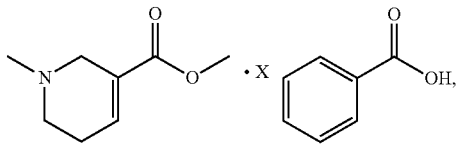

wherein X is a molar ratio of arecoline to benzoic acid and has a value of $0.5 \leq X \leq 10$.

2. The arecoline salt according to claim 1, wherein X has a value of $0.5 \leq X \leq 2$ $0 < X \leq 10$ $0 < X \leq 8$ $0 < X \leq 6$ $0 < X \leq 5$ $0 < X \leq 3$ $0 < X \leq 2$.

3. The arecoline salt according to claim 2, wherein the arecoline salt has a structural formula as follows:

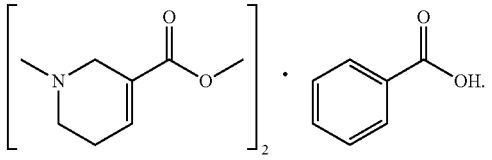

4. The arecoline salt according to claim 2, wherein the arecoline salt has a structural formula as follows:

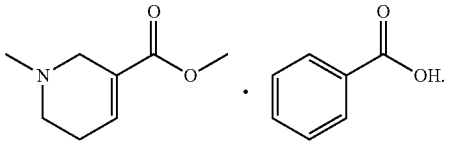

5. The arecoline salt according to claim 2, wherein the arecoline salt has a structural formula as follows:

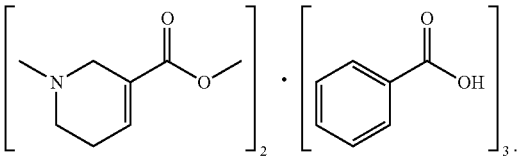

6. The arecoline salt according to claim 2, wherein the arecoline salt has a structural formula as follows:

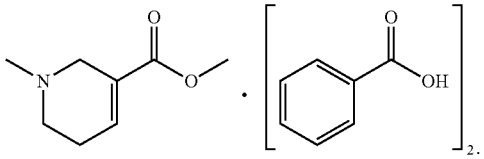

7. A preparation method for an arecoline salt, comprising the following steps: placing arecoline in a reactor, adding benzoic acid under stirring and heating for dissolution to obtain the arecoline salt; wherein the prepared arecoline salt has a structural formula as follows:

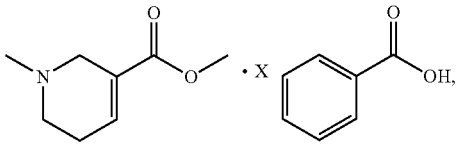

where X is a molar ratio of the arecoline to the benzoic acid and has a value of $0.5 \leq X \leq 10$.

8. The preparation method according to claim 7, wherein the heating is carried out at 20-100° C., 20-80° C., further 40-80° C., further 50-80° C., or further 50-70° C.

9. The preparation method according to claim 7, wherein X has a value of $0.5 \leq X \leq 2$ $0 < X \leq 10$ $0 < X \leq 8$ $0 < X \leq 6$ $0 < X \leq 5$.

10. The preparation method according to claim 9, wherein the prepared arecoline salt has a structural formula as one of the following:

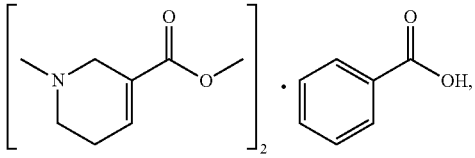

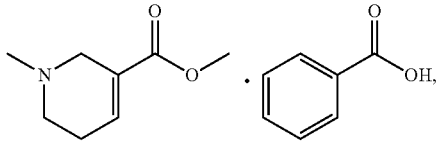

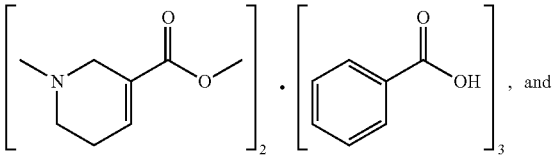

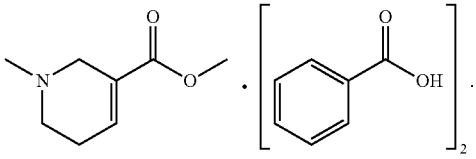

11. A preparation method for an arecoline salt, comprising the following steps:

dissolving arecoline hydrobromide in water to obtain an aqueous arecoline hydrobromide solution;

adjusting the aqueous arecoline hydrobromide solution to an alkalinity, and extracting with an organic solvent to obtain an organic solvent layer and a water layer; and adding benzoic acid to the organic solvent layer for dissolution to obtain an arecoline salt;

wherein the arecoline salt has a structural formula as follows:

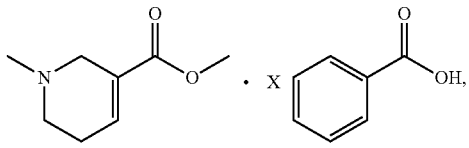

wherein X is a molar ratio of the arecoline to the benzoic acid and has a value of $0.5 \leq X \leq 10$.

12. The preparation method according to claim 11, further comprising the following steps: adding water to the organic solvent layer for back extraction, and adjusting a water phase to an alkalinity to obtain a secondary organic solvent layer and a water layer; and adding benzoic acid to the secondary organic solvent layer for dissolution to obtain an arecoline salt.

13. The preparation method according to claim 12, wherein the alkalinity is that the adjusted water phase has a pH value of 7-10, 7-9.5, further 7-9, further 7.5-9, or further 8-9.

14. The preparation method according to claim 12, wherein after the secondary organic solvent layer is dried, benzoic acid is added for dissolution to obtain an arecoline salt.

15. The preparation method according to claim 11, wherein the obtained arecoline salt is concentrated and dried to improve purity of the arecoline salt.

16. The preparation method according to claim 11, wherein the organic solvent is selected from the group consisting of at least one of:

ethyl acetate, benzene, toluene, xylene, petroleum ether, methyl ether, ethyl ether, methyl tert-butyl ether, dichloromethane, trichloromethane, ethyl acetate, tetrahydrofuran and n-butyl alcohol.

17. A product with an areca nut flavor, wherein the product comprises the arecoline salt according to claim 1.

18. The product according to claim 17, wherein the product is an aerosol generation substrate configured to be atomized to generate a smokable aerosol; or the product is a filter capsule, a chewing gum, or a beverage.

19. The product according to claim 17, wherein the aerosol generation substrate is a liquid phase configured to be atomized by any one of a heating atomizer, an ultrasonic atomizer, an air compression atomizer, or a press-type spraying device to generate an aerosol.

20. The product according to claim 17, wherein the aerosol generation substrate is a solid phase configured to generate a smokable aerosol when heated below an ignition point.

* * * * *